United States Patent [19]

Chamberlain

[11] 3,977,651

[45] Aug. 31, 1976

[54] DYNAMIC CARPET STRETCHER

[76] Inventor: Charles Melvin Chamberlain, 1032 Ballard Place, Fort Myers, Fla. 33901

[22] Filed: Aug. 22, 1975

[21] Appl. No.: 606,940

[52] U.S. Cl. ..... 254/57; 254/62
[51] Int. Cl.[2] ..... A47G 27/04
[58] Field of Search ..... 254/57–63

[56] References Cited

UNITED STATES PATENTS

| | | | |
|---|---|---|---|
| 3,022,979 | 2/1962 | Dahlke | 254/62 |
| 3,572,800 | 3/1971 | Graziano | 254/57 |
| 3,917,225 | 11/1975 | Payson | 254/60 |

*Primary Examiner*—Al Lawrence Smith
*Assistant Examiner*—Robert C. Watson
*Attorney, Agent, or Firm*—Julian C. Renfro

[57] ABSTRACT

A carpet tightening device enabling a suitable tightening force to be applied to a portion of a carpet without requiring substantial force to be delivered by the operator's knee, comprising an elongate housing having a knee pad mounted at its rear end, and a toothed carpet-engaging member mounted at its front end. The housing member is hollow and contains an elongate compression spring therein. An elongate handle is pivotally mounted atop the housing, and connected so as to enable an operator to apply a substantial compressive force to the spring. A forward portion of the spring is, on occasion of spring release, brought into contact with a portion of the carpet-engaging member disposed inside the housing, thus to cause the toothed portion of the carpet-engaging member to move forward with considerable force to accomplish a carpet tightening operation. Latch means under the control of the operator makes it possible for the spring to be maintained in a compressed condition until such time as the operator decides to release same, thus to allow the forward end of the spring to move into forceful contact with the aforementioned portion of the carpet engaging member disposed inside the housing. Advantageously, the handle is disposed so as to be moved in the carpet-engaging direction as the spring is being compressed, and a scale is provided on my device, revealing to the operator at a glance, the degree of compression of the spring. The latch arrangement enables the operator to release the spring, to bring about carpet-tightening, at whatever force level he deems appropriate at a given instance.

17 Claims, 7 Drawing Figures

DYNAMIC CARPET STRETCHER

BACKGROUND OF THE INVENTION

1. Field of the Invention

This invention relates to a novel device for the installation of carpets, large rugs, fabrics and the like, and more particularly to a manually operated apparatus for stretching a carpet to the desired degree of tautness during its installation, so that a desirably flat, smooth surface is obtained.

2. Description of the Prior Art

Before the present wide-spread use of mechanically operated carpet stretchers, the carpet installer had a very difficult task during carpet installation, in order to insure that the carpet lay in a flat enough manner as to be attractive, and so as not to cause a passerby to trip and fall.

Various hooked devices that were previously utilized for carpet installation had the unfortunate characteristic of slippage on the one hand, and of piercing the carpet if too much force was applied. Additionally, the use of such devices required considerable physical strength, thereby causing the installer to quickly become exhausted.

After the introduction of the mechanical carpet stretcher, such devices quickly became exceedingly popular in that the arms of the installer were by and large free from strenuous efforts, and chance of damaging the carpet was minimal. These devices involved an elongate housing with carpet-engaging teeth at one end, and a knee pad at the other end, with the arrangement being such that the device was laid upon the carpet at or near the location at which the tightening operation was to take place. The installer then got on his hands and knees, and proceeded to swing one knee forward into striking contact with the padded end of the carpet stretching device, thus driving the elongate housing forward. Because the forward end of the device used teeth positioned to effectively grip the carpet, each time the installer "kneed" the device forward, such accomplished a desirable additional amount of stretching of the carpet. By appropriately positioning the stretcher at successively different locations on the carpet, a properly skilled installer was able to rather quickly achieve a desired degree of tautness of the carpet, so that by the time the carpet was tacked, glued or stapled in the desired position, a very attractive installation was brought about.

Unfortunately, certain disadvantages have accompanied the use of these mechanically-operated carpet stretching devices, particularly the fact that after years, or sometimes after only months of operating such a device, an installer often begins to have various knee complaints, such as stiffness, enlargement, or even constant pain. It is to obviate such unfortunate effects as these that the present invention was evolved.

I recognize that my device is not the first one to propose the use of a mechanically operated carpet stretching device in which considerable knee effort is obviated, but it nevertheless is sincerely believed to be the first practical and truly successful device in which effort applied to a spring-compressing handle by an installer is in a proper and effective direction insofar as the tightening direction of the carpet is concerned.

SUMMARY OF THE INVENTION

In the preferred embodiment, my novel carpet stretching device involves the use of an elongate housing means having a knee pad disposed at its rear end, and a toothed carpet-engaging member movably mounted at its front end. The housing means is substantially hollow and contains therein a rather powerful compression spring that is disposed with its one end in active association with a member attached to the carpet-engaging member, and its other end in contact with novel tightening means.

These tightening means include an elongate handle that is pivotally mounted atop the housing, and movable for a substantial extent in a plane passing essentially parallel to, if not along, the centerline of the housing. The handle is normally inclined somewhat to the rear from what would be a vertical position, with the handle being moved forward, in the direction of the toothed, carpet-engaging member, in order to bring about compression of the spring. The movement of the handle in the spring-compressing direction typically takes it through the vertical position, and into a position in which it is inclined toward the carpet-engaging member. A suitable latch member is disposed in the housing, to serve the function of retaining the spring in the desired compressed condition, in which condition it remains until such time as the operator wishes to apply this stored energy toward the desired carpet stretching operation.

A trigger member is provided on the housing so that at the time the installer deems appropriate, he can bring about a sudden release of the compressed spring, allowing the spring to move forward and in turn cause a sudden forward movement of the toothed carpet-engaging member. This of course results in the carpet in the immediate vicinity of the toothed member being moved forward, thus to accomplish the desired carpet stretching operation. Backward movement of the elongate housing at this time is prevented by the provision of the knee pad, against which the knee of the installer is placed at a time immediately prior to the release of the spring. However, it is to be emphasized that he merely needs to apply knee pressure, for it is entirely unnecessary in accordance with this invention for the installer to strike the knee pad with his knee.

Various other constructional details may of course be utilized, such as a driver body normally surrounding the spring, and an anvil member in the forward inner portion of the housing, operatively associated with the carpet-engaging portion. The driver body gives additional mass to the spring, so that when released, it will strike the anvil in the most effective manner. It is most important to note that the manner in which the operating handle is mounted on the housing is novel, for quite advantageously, the handle is moved forward to bring about spring compression, and thereafter the carpet stretching operation, rather than the handle being pushed downwardly, or in any other ineffective direction, during the spring-compression phase. Additionally, it is to be noted that the force of the compressed spring is released only at a time the operator or installer deems appropriate, rather than the spring being released at such time as a particular handle position has been reached, as taught by the prior art.

It is therefore to be seen that it is a principal object of my invention to provide a carpet stretching device that makes it possible for an installer to accomplish a highly effective carpet installation without injury to himself and without involving an exhausting ordeal.

It is another object of my invention to provide a carpet stretching device utilizing a powerful spring means for storing energy, with the compression of such spring being brought about by the appropriate manipulation of an upstanding handle, with the direction of such handle manipulation being in the forward direction thereby to enhance and compliment the carpet stretching operation.

It is still another object of my invention to provide in a carpet stretching device that utilizes a conveniently placed latch means the installer manipulates at such time as release of the spring is desired, thereby avoiding an arrangement in which the spring is released as a function of handle position.

It is yet another object of my invention to provide a carpet stretching device that can apply considerably more force than can be applied by the use of a "knee kicker" type device.

It is yet still another object of my invention to provide a scale on a carpet stretcher, visible to the operator at a glance, so that he can ascertain the degree of compression of the driver spring, and be able to release the spring at a desired energy level.

These and other objects, features and advantages of my invention will be more apparent as the description proceeds.

DETAILED DESCRIPTION

Figure 1:
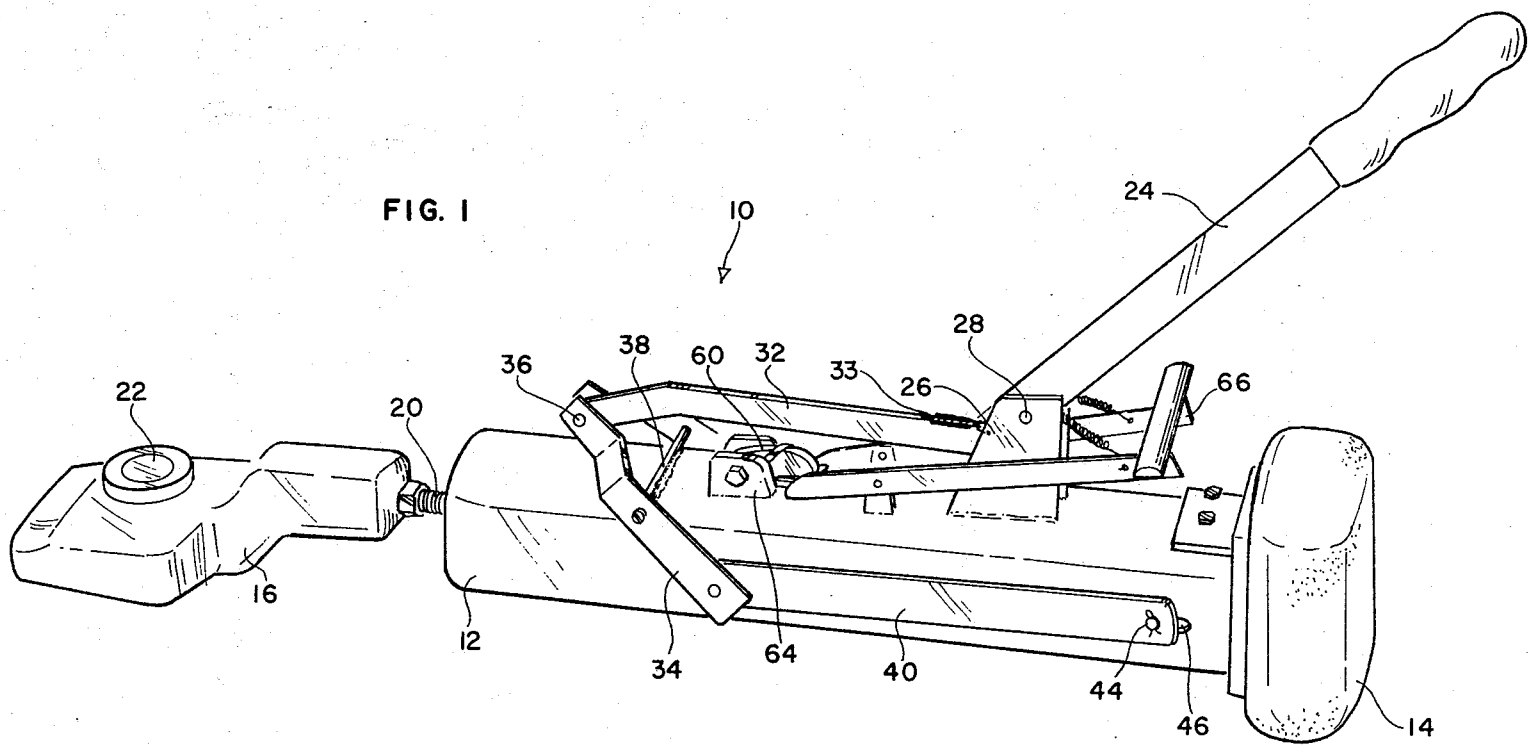
FIG. 1 is an overall perspective view of my device, revealing the handle that is moved forwardly, toward the carpet-engaging member, at such time as the driver spring is to be compressed.

Turning to FIG. 1, it is there to be seen that I have illustrated a lightweight carpet stretching apparatus 10 in accordance with my invention, principally involving an elongate housing means or member 12, typically of aluminum. Affixed at the rear end of the housing is a knee pad 14, whereas a toothed carpet-engaging member 16 is movably mounted at the front end of the device.

Figures 2, 2A, 2B:
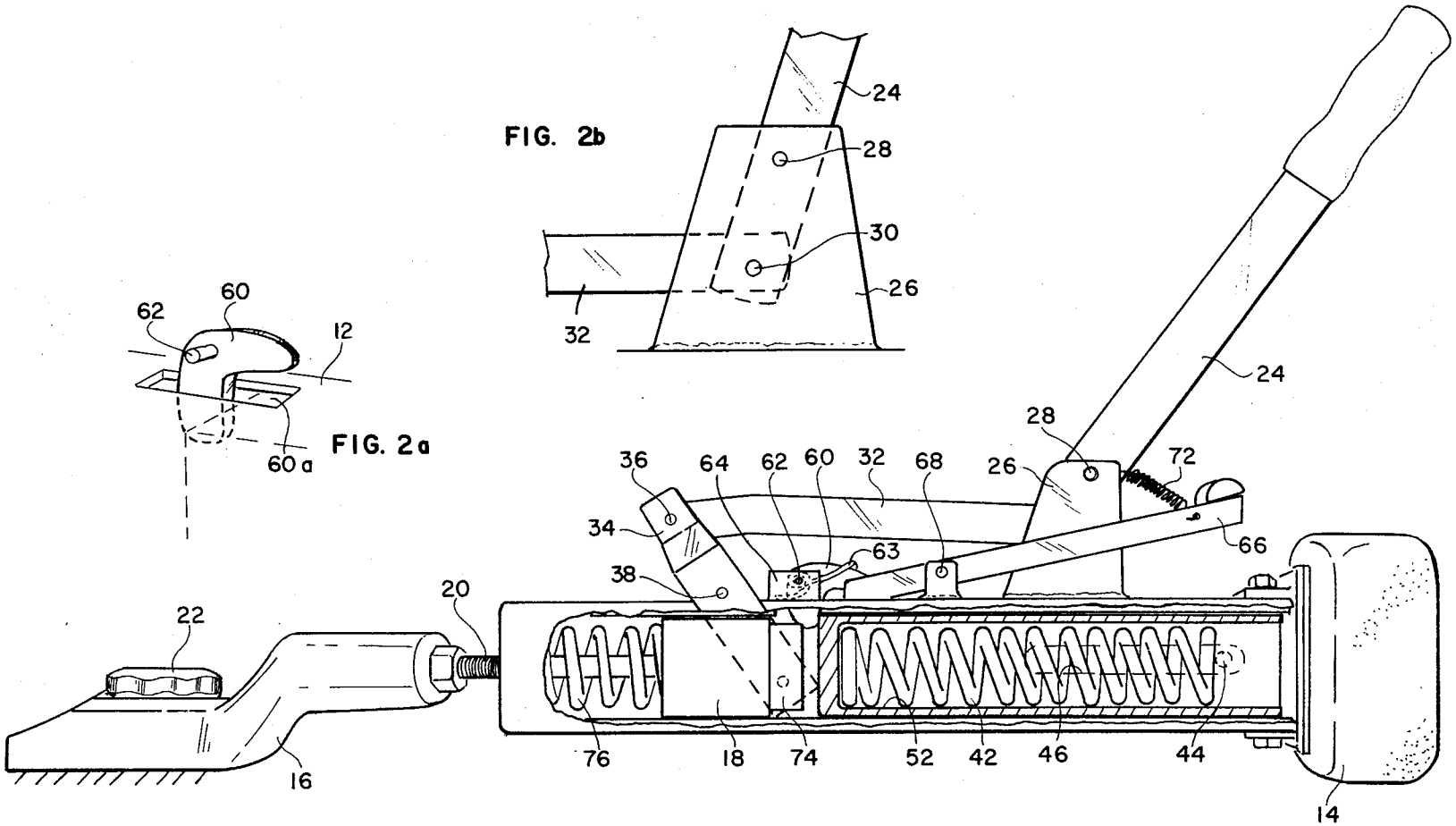
FIG. 2 is a side elevational view with certain portions removed in order to reveal internal construction.
FIG. 2*a* is a fragmentary view of the latch used to hold the spring in compressed condition.
FIG. 2*b* is a fragmentary view revealing the manner in which the lower portion of the handle is attached to the forwardly-extending link.
Figure 3:
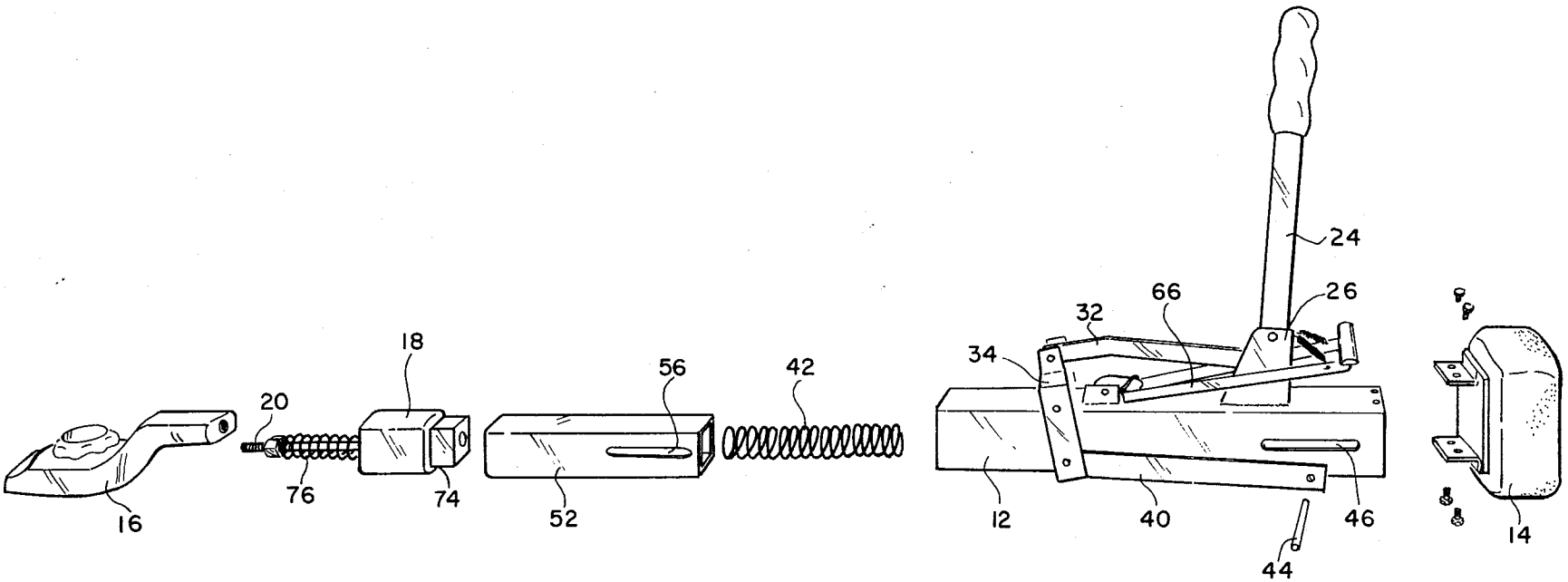
FIG. 3 is an exploded view of my device, revealing components used therein.

As will be noted from FIGS. 2 and 3, an anvil member 18 is mounted at the forward end of the hollow interior of the housing 12, with a suitable connecting means, such as a rod 20, being utilized for interconnecting the anvil with the carpet-engaging member 16. The rod is arranged to pass through an aperture (not shown) in the forward wall of the housing member. Although the carpet-engaging member 16 is a commercially available device and not per se a part of my invention, it nevertheless should be pointed out that I prefer for the member 16 to be a type in which the extent of tooth protrusion from the bottom of the device can be controlled by suitable adjustment, such as by rotating a member 22 or the like that selectively accomplishes the amount of tooth protrusion desired. The head 12 used in the Graziano U.S. Pat. No. 3,498,661 is an example of one type of head usable in the instant device.

Figure 4:
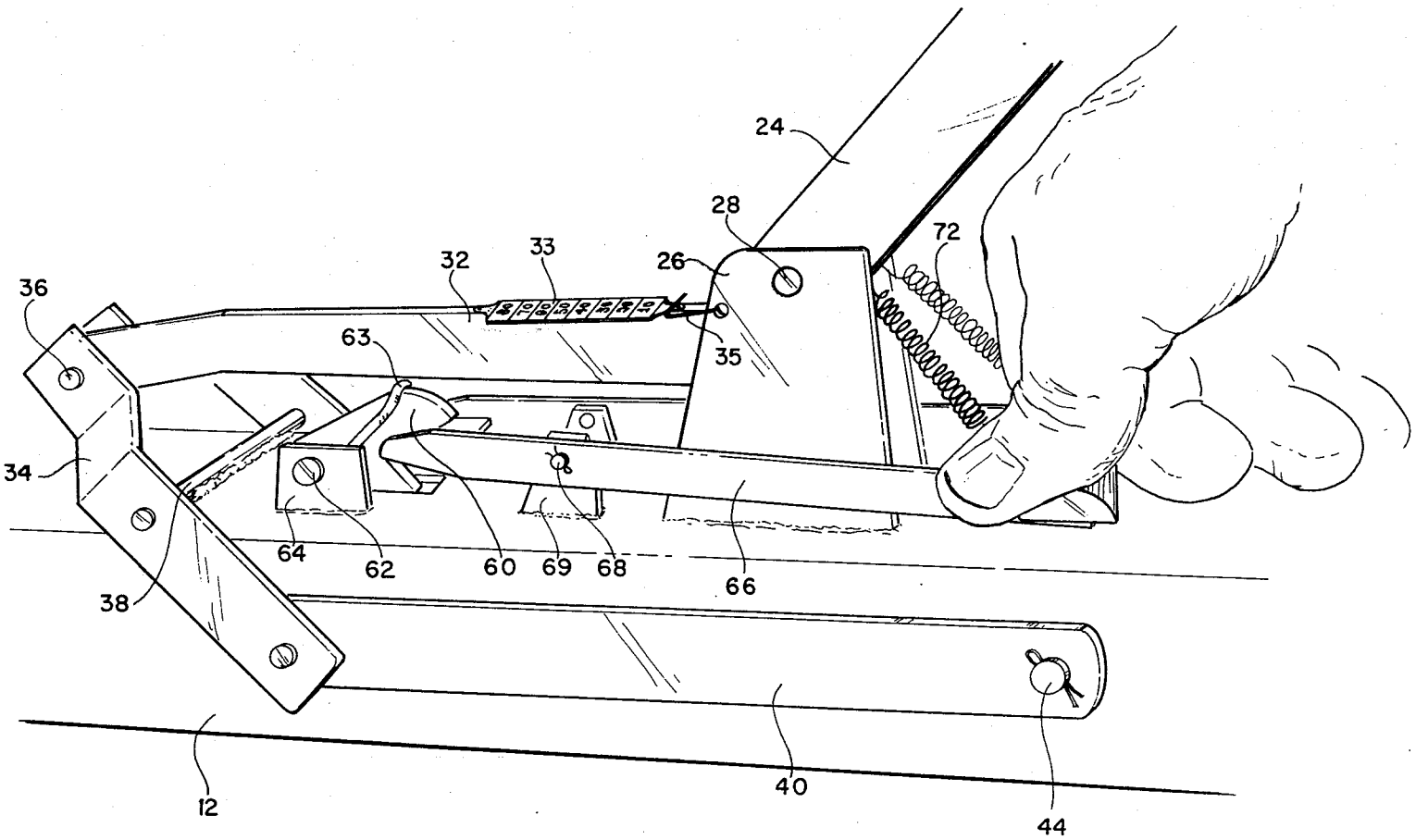
FIG. 4 is an enlarged view of the mid portion of my device, revealing the scale and pointer utilized in order that the number of pounds of spring compression can be rapidly revealed.
Figure 5:
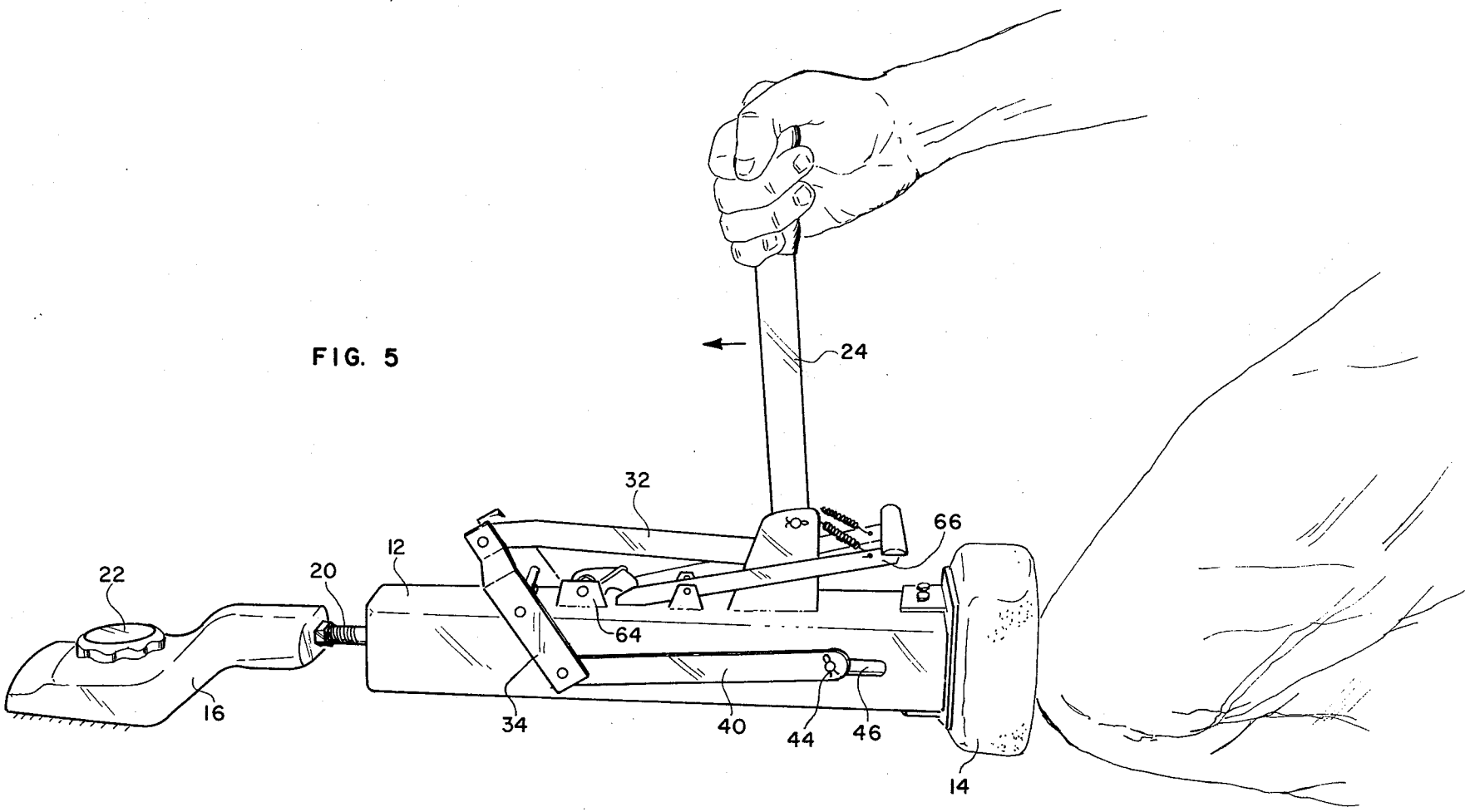
FIG. 5 is a view revealing the device in operation, with the toothed carpet-engaging member in contact with a carpet, and the handle being moved in the direction of such member during the compression of the driver spring.

FIG. 1 as well as FIGS. 2 and 3 reveal the use of an upstanding handle 24 of elongate construction that is mounted atop the housing 12, typically at a location somewhat toward the rear of the device. In order that the handle 24 can undertake a suitable range of manipulative movements in a plane passing essentially parallel to, if not along, the centerline of the housing, I provide a spaced pair of handle support member 26 in the nature of a clevis. These members are welded to the upper surface of the housing, with the spacing between the members 26 being such as to accommodate a handle of appropriate thickness. Note FIG. 4. A suitable hole is provided in the lower portion of the handle as well as through the members 26, and through these holes a pin 28 extends, with the pin serving as a fulcrum point about which the handle can be rotated by the carpet installer.

As revealed in FIG. 2*b*, the lower portion of the handle extends below the pin 28, with another pin 30 being used to connect the lowermost portion of the handle to a forwardly extending link 32. In this manner, as the handle is forced forward, in the direction of the member 16, by the installer so as to cause a counterclockwise movement about the pin 28, the link 32 is caused to move rearwardly for a purpose soon to become apparent.

The handle 24 is normally angled somewhat to the rear from what would be a vertical position, with the handle able to be forced forward by the operator in order to bring about compression of the spring 42 disposed in the housing 12. The movement of the principal portion of the handle 24 in the spring-compressing direction typically takes it through a vertical position with respect to the upper surface of the housing 12, and into a position in which it is inclined toward the carpet-engaging member 24.

The link 32 extends from the handle forwardly to a position of pivotal contact with a bifurcated device 34. The member 34 is supported in a rotatable manner with respect to the housing by means of a fulcrum pin 38 that is attached to the upper surface of the housing, such as by welding. The forwardmost part of the link 32 is attached to the uppermost portion of the member 34 by means of a pin 36, with the joint being such as to present little restraint to the relative motion of these members. As should be apparent, at such time as the handle is moved forwardly, which is in the counterclockwise direction as viewed in the figures of drawing, the bifurcated link 34 is caused to move in a clockwise direction about the pin 38.

Each of the lower arms of the member 34 are pinned to respective links 40 that reside along the exterior of the housing member 12. The aforementioned clockwise movement of the member 34 about the elongate pin 38 therefore causes the link 40 on each side of the device to move forward, with this in turn causing an appropriate compression of the driver spring 42, visible in FIG. 2.

The spring 42 is preferably a powerful spring, requiring a force in the vicinity of 60 pounds for the compression of same. However, because of the mechanical advantage that is obtained by the handle arrangement I use, a suitable amount of compression of the spring 42 can be obtained without a prohibitive amount of force having to be applied to the handle 24.

I prefer an interconnection arrangement between the links 40 and the spring 42 that involves an elongate pin 44 that extends entirely through the housing member 12, with suitable means, such as a cotter key, being utilized at each end of the pin 44 in order that contact with the rear ends of the links 40 will be maintained. So that the pin 44 can move over appropriate distances along the length of the housing 12, I provide a slot 46 on each side of the device 12, which slots of course extend longitudinally as depicted in FIG. 2 and FIG. 3. Therefore, as the handle is rotated forwardly about pin 28, the pin 44 is caused to move forwardly in the housing, along the slots 46, and to bring about compression of the elongate spring 42, in a manner now to be described.

As best viewed in FIG. 2, the elongate spring 42 may reside in a driver body 52, with latter device not only preventing undue rubbing of the coils of the spring along the interior of the housing, but also the driver body serves to increase the mass associated with the released spring, thus enhancing the effect brought about against the anvil at such time as the spring is released. The driver body may be of round cross-section, or be square in cross-section, as is to be seen in FIG. 3, but in any event, it must fit properly within the housing 12, and not tend to stick or bind. The forwardmost part of the driver body is preferably thickened somewhat in the location intended to encounter the anvil as revealed in FIG. 2, but with the rear end of the driver body typically being open. As pointed out in the exploded view of my invention depicted in FIG. 3, the driver body 52 is provided with slots 56 that are essentially coextensive with the slots 46 in the housing member 12. Thus, because of the provision of the matching slots, there is no impediment to the forward movement of the long pin 44 during the spring-compressing phase of operation.

If the driver body was not restrained, it as well as the spring 42 would obviously tend to move forward during such time as the handle 24 was being moved forward. To prevent this undesirable movement, I provide a latch member 60, which for example may be mounted by means of a pin 62 on a clevis 64 on an upper portion of the housing, and extend through a suitable slot **60*a* provided in the upper wall of the housing. The latch 60 is preferably L-shaped, with one arm of the L extending vertically down in front of the driver body, to restrain the driver body against forward movement, and with the other arm being contacted by a spring 63 arranged to bias the latch into the approximate position shown in FIGS. 2 and 2*a*. At such time as the driver body is to be released, so that it can deliver a power stroke to the anvil 18, the latch member is caused to pivot about its pin 62, in a counter-clockwise direction as shown in these figures, thus to cause the lower arm of the latch to move out of engagement with the driver body. This pivotal movement is brought about by a lifting effect accomplished with respect to the substantially horizontally disposed arm of the L-shaped latch 60**.

In order to make it possible for the operator to have close control over the release action of the latch, I provide an elongate release handle 66, which is preferably supported by a pin 68 mounted in a suitable clevis 69 on the housing 12, between the handle supporting members 26, and the latch member 60. One end of the release handle extends below the horizontal arm of the L-shaped latch member, whereas the long portion of the release handle extends rearwardly behind the pin 68, to a point behind the members 26; note FIG. 4.

The release handle 66 is typically spring biased into a position such that inadvertent release of the latch member 60, and therefore inadvertent release of the spring 42, is effectively prevented. Such is accomplished in accordance with this invention by the use of one or more short tension springs 72, that normally serve to lift the rear portion of the release handle 66, and thus prevent any upward movement of the forward portion of the member 66. However, when by a deliberate effort the operator presses down on the trigger means 66 in the manner shown in FIG. 4, the spring bias is overcome, the latch member is caused to pivot about its pin 62, and the driver body 52 is allowed to go forward with great force under the influence of driver spring 42, thus striking the anvil 18 and bringing about a highly effective forward movement of the toothed carpet-engaging member 16 with respect to the housing 12.

In order to prevent undue shock to the user and to minimize noise, I typically utilize a shock bumper 74 such as of rubber or the like on the rear end of the anvil, thus preventing metal-to-metal contact when the anvil is struck by the forward end of the driver body. I prefer for the forward end of the driver body to be made of steel.

For an effective and rapid operation of my device it is desired to have the anvil member promptly returned to a position approximating the position shown in FIG. 2, rather than remaining in the forwardmost portion of the interior of the housing 12. To that end, I provide an ancillary compression spring 76 around the exterior of the rod 20, which spring serves to push the anvil 18 away from the forwardmost wall of the housing member 12 at all times except of course when the anvil is being forced forwardly by the action of the driver spring 42.

The spring 76 is large enough to move the anvil into the close proximity of the driver body, and at the same time achieve a desired retraction of the toothed member into a position close to the front end of the housing, preparatory for the next stroke. However, I typically do not select a return spring 76 powerful enough to accomplish a resetting of the latch with respect to the front of the driver body. Therefore, it is typically necessary for the operator to manually reset the latch, which is accomplished by moving the handle 24 rearwardly. This handle action causes the pin 44 to bottom in the rear portions of the slots 56 in the driver body, and this causes the driver body to move in a rearward direction in the housing 12.

The latch has remained in a tilted position on the top of the driver body during the entire time the driver body was in a forward position. Therefore, upon the driver body being pulled rearwardly by the action of the pin 44, the latch is able to move back into its driver body-restraining position, with the bias spring 63 contributing importantly to the latch resuming the position illustrated in FIG. 2. Typically, the forward end of the driver body is approximately three-fourths of an inch away from the anvil member when the driver body is in the latch position shown in FIG. 2.

Through tests I have found that the return spring 76 should be approximately a 20 pound spring, for if it is much less than that, it cannot accomplish a rapid resetting of the toothed head member to the position adjacent the housing, and if it is much stronger than that, it tends to diminish the efficacy of the driver spring. As to the driver spring 42, as indicated above, it typically is a 60 pound spring, but should this prove to be the incorrect size for a certain carpet installer, it is but a simple matter to replace the spring 42 with one of a more appropriate size. This can be accomplished easily by removing the small bolts (visible in FIGS. 2 and 3) that serve to hold the knee pad on the housing, and removing the pin 44. Upon the substitution of the replacement spring and the reinstallation of the bolts and pin, the carpet installer can then proceed to use the device in the same manner as before.

It is to be pointed out that it is less likely than in other devices that the installer will find it necessary to make a driver spring substitution. This is because in the practice of this invention, the carpet installer can selectively vary the degree of compression of the driver spring by carefully controlling the amount of forward motion he gives to the handle 24. In view of this, it is desirable to provide a scale and pointer arrangement so that the operator can quickly ascertain, during the manipulation of the handle, how much spring force he has built up. To that end, I provide an elongate scale 33 that is secured along the top of a rear portion of the link 32. This scale is graduated in pounds, as revealed in FIG. 4, and is sufficiently narrow to pass easily between the clevis members 26 without binding.

A fixed pointer 35 is provided on one portion of the member 26, which pointer is disposed adjacent the scale, and effectively serves to indicate to the operator, the amount of spring force that has been created at any moment as a result of handle manipulation. Obviously, he can, through experience, achieve a skill level such that he will know when the spring force has been built up as to be sufficient in a given instance. At such time, release of the spring is brought about by manipulation of the trigger means 66, typically by the use of his other hand.

It is to be noted that by the use of my device, an experienced carpet installer can rapidly and dynamically achieve a desired tautness of the carpet he is installing, without at any time undertaking any knee damaging efforts. Most importantly, his movements of the handle 24 in the spring-compressing direction are entirely consistent with the direction he is endeavoring to move the carpet, which of course means that all handle movements in the spring compressing direction not only supplement the action of the large spring, but also serve to keep the teeth of the member 16 in desirable engagement with the carpet. By keeping his other hand near the trigger means 66 during movements of the handle 24, the carpet installer can cause a rapid series of carpet-tightening strokes to be delivered by the head 16, with each stroke being of a preascertained force level.

I claim:

1. A carpet tightening device requiring little force to be delivered by the operator's knee, comprising an elongate housing having a knee pad mounted at its rear end, and a toothed carpet-engaging member movably mounted at its front end, said housing being substantially hollow and containing an elongate compression spring, an elongate handle means pivotally mounted in an upright position atop said housing, means connecting a portion of said handle with spring-contacting means, said handle normally being angled in a position slightly to the rear of a vertical position, and being movable by the operator in a forward direction therefrom, said handle, upon being moved in the forward direction, serving to bring about substantial compression of said spring, latch means serving to hold said spring in the compressed condition, and trigger means connected to bring about operation of said latch means so as to release the force of said spring at the behest of the user, said spring, upon being released, bringing about a forceful forward movement of said toothed means, away from said housing.

2. The carpet tightening device as defined in claim 1 in which a scale is provided for indicating the degree of compression of said spring, thus enabling the operator to ascertain the extent of force that will be delivered when the latch means is operated to release said spring.

3. The carpet tightening device as defined in claim 1 in which a driver body, slidably mounted in said housing, substantially surrounds said compression spring, and an anvil member is disposed in a forward portion of the interior of said housing, said anvil member being operatively connected to said toothed carpet-engaging member, whereby upon the operation of said trigger means, said latch means releases said driver body, allowing it to move under the influence of said spring into sudden, forceful contact with said anvil, thus bringing about a carpet-tightening action by said toothed member.

4. The carpet tightening device as defined in claim 1 in which said handle is movable in a plane substantially parallel to, if not passing through, the longitudinal centerline of said housing.

5. A carpet tightening device enabling substantial force to be applied to a portion of a carpet without requiring extensive amounts of knee effort, comprising an elongate housing having a knee pad at its rear end, and a member containing carpet-engaging teeth movably mounted at its front end, said housing being essentially hollow and containing an elongate compression spring therein, an elongate handle member mounted for pivotal movement atop said housing member, said handle being disposed in an upright position and normally angled somewhat to the rear from a vertical position, linkage means attached to said handle, and connected with one end of said spring, such linkage means enabling a force applied to said handle in a forward direction to be utilized in the compression of said spring, latch means for interacting with said spring and releasably maintaining it in a compressed condition, and trigger means for operating said latch means to cause the release of the compressed spring at a time selected by the operator, thus allowing the potential energy stored in said spring to be directed forwardly and causing said toothed member to suddenly move forward, away from said housing with considerable force, thus accomplishing a carpet-tightening action.

6. The carpet tightening device as defined in claim 5 in which a graduated scale is provided for indicating the degree of compression of said spring at any given moment, thus enabling the operator to ascertain the extent of force that will be delivered when said latch means is operated to release said spring.

7. The carpet tightening device as defined in claim 5 in which a driver body, slidably mounted in said housing, essentially surrounds said compression spring, said latch means being in contact with said driver body, and an anvil member slidably disposed in a forward portion of the interior of said housing, said anvil member being operatively connected to said toothed carpet-engaging member, whereby upon the operation of said trigger means, said latch means releases said driver body, allowing it to move under the influence of said spring into sudden, forceful contact with said anvil, and bringing about a carpet-tightening action by said toothed member.

8. The carpet tightening device as defined in claim 5 in which saidi handle is movable in a plane substantially parallel to and adjacent the longitudinal centerline of said housing.

9. The carpet tightening means as defined in claim 5 in which a return spring is provided in said housing, in operative association with said toothed carpet-engaging member, to return same to a position close to the forward end of said housing subsequent to a carpet-tightening stroke of said carpet-engaging member.

10. A carpet tightening device enabling great force to be applied to a portion of a carpet without requiring extensive amounts of knee pressure, comprising an elongate housing having a knee pad at the rear end, and a member containing carpet-engaging teeth at the front end, said housing being essentially hollow and containing an anvil member movably disposed therein, rod means interconnecting said anvil member and said tooth containing member, with said rod means extending through a front wall of said housing and being slidably disposed therein, an elongate handle member mounted in an upright position atop said housing member, said handle normally being angled somewhat to the rear from a vertical position, and being movable forwardly therefrom, an elongate compression spring disposed in said housing, linkage means attached to said handle enabling a force applied to said handle in a forward direction to be utilized in the compression of said spring, latch means for preventing substantial spring movement during the compression thereof, and trigger means for operating said latch means to cause the release of the compressed spring at a time selected by the operator, thus allowing the potential energy stored in said spring to be directed forwardly, a driver member operatively associated with a forward end of said spring, such that upon release of said spring, said driver member is caused to strike said anvil with great force, whereby upon the rear end of said housing being braced against any substantial amount of movement when said latch is operated, said toothed member is caused to suddenly move forward with respect to the housing, thus accomplishing a carpet tightening action.

11. The carpet tightening device as defined in claim 10 in which a scale is provided for indicating the degree of compression of said spring, thus enabling the operator to release said compression spring at a selected force level.

12. The carpet tightening device as defined in claim 10 in which said handle is mounted for a range of movements in a plane parallel to, and closely adjacent, the centerline of said compression spring.

13. The carpet tightening device as defined in claim 10 in which a return spring is disposed in a forward part of said housing, serving to return said toothed member to a position close to the forward end of said housing subsequent to a delivery of force to the carpet.

14. A carpet tightening device requiring little force to be delivered by the operator's knee, comprising an elongate housing means having a knee contacting member at its rear end, and a toothed rug-engaging member movably mounted at its front end, said housing means being substantially hollow and containing therein an anvil member, connecting means passing through the front wall of said housing member in a slidable manner and interconnecting said anvil member with said toothed member, an elongate compression spring disposed in said housing, and having a driver member disposed at its forward end, handle means disposed atop said housing and movable by the operator over a range of positions, said handle normally residing in a position in which it is angled somewhat to the rear from a vertical position, linkage means connected to said handle and serving to bring about substantial compression of said spring at such time as said handle is moved in the forward direction, latch means serving to engage the forward portion of said driver member and normally preventing forward movement, and trigger means connected to bring about operation of said latch so as to release the force of said spring at the behest of the user, said spring, upon being released, causing the associated driver member to impact against said anvil, thereby bringing about a forceful forward movement of said toothed means with respect to said housing.

15. The carpet tightening device as defined in claim 14 in which a scale is provided for indicating the degree of compression of said spring, thus enabling the operator to release said spring at a selected force level.

16. The carpet tightening device as defined in claim 14 in which said handle is movable in a plane substantially parallel to the longitudinal centerline of said housing.

17. The carpet tightening device as defined in claim 14 in which said handle is normally operated by the operator's one hand, and said trigger means operated by the operator's other hand.

* * * * *